US010745981B2

(12) United States Patent
Brutaru

(10) Patent No.: US 10,745,981 B2
(45) Date of Patent: Aug. 18, 2020

(54) STRUCTURAL SUPPORT GUIDING SYSTEM FOR A HYDRAULIC BAR LIFT OF A DIRECTIONAL DRILLING MACHINE

(71) Applicant: Viorel Gabriel Brutaru, Boca Raton, FL (US)

(72) Inventor: Viorel Gabriel Brutaru, Boca Raton, FL (US)

( * ) Notice: Subject to any disclaimer, the term of this patent is extended or adjusted under 35 U.S.C. 154(b) by 117 days.

(21) Appl. No.: 16/241,339

(22) Filed: Jan. 7, 2019

(65) Prior Publication Data

US 2020/0217150 A1 Jul. 9, 2020

(51) Int. Cl.

| | |
|---|---|
| ***E21B 19/15*** | (2006.01) |
| ***E21B 15/04*** | (2006.01) |
| ***E21B 7/04*** | (2006.01) |
| ***B66F 13/00*** | (2006.01) |

(52) U.S. Cl.

CPC ..... *E21B 19/15* (2013.01); *E21B 7/046* (2013.01); *E21B 15/04* (2013.01); *B66F 13/00* (2013.01); *E21B 19/155* (2013.01)

(58) Field of Classification Search

CPC ..... B66F 13/00; E21B 19/086; E21B 19/15; E21B 19/155; E21B 7/003; E21B 7/04; E21B 7/046

See application file for complete search history.

(56) References Cited

U.S. PATENT DOCUMENTS

| | | | | | |
|---|---|---|---|---|---|
| 2,536,550 | A * | 1/1951 | Hughes | B66F 5/00 | 254/133 R |
| 2,617,547 | A * | 11/1952 | Pridy | B60P 3/40 | 414/746.2 |
| 2,956,782 | A * | 10/1960 | Mistrot | E21B 19/155 | 173/195 |
| 3,567,182 | A * | 3/1971 | Steele | B60S 9/04 | 254/4 B |
| 4,194,726 | A * | 3/1980 | Hance | B66F 3/36 | 254/133 R |
| 4,426,182 | A * | 1/1984 | Frias | E21B 19/15 | 193/17 |
| 5,273,388 | A * | 12/1993 | Willis | E21B 19/155 | 187/210 |
| 5,947,449 | A * | 9/1999 | Dube | A47G 27/0487 | 254/108 |
| 6,298,927 | B1 * | 10/2001 | Back | E21B 19/14 | 166/77.51 |
| 6,769,655 | B2 * | 8/2004 | Beese | B66F 3/36 | 248/188.1 |
| 8,132,788 | B2 * | 3/2012 | Realegeno-Amaya | B66F 3/36 | 254/133 R |

* cited by examiner

*Primary Examiner* — Tyrone V Hall, Jr.
(74) *Attorney, Agent, or Firm* — Ruben Alcoba, Esq.

(57) ABSTRACT

A structural support guiding system that reinforces a set of rods that are used by a hydraulic bar lift to lift iron tubes or drilling stems into a holding bin of a directional drilling machine. The structural support guiding system is a guiding system that attaches to a direct drilling machine at two distinct points that are adjacent to the direct drilling machine's hydraulic bar lifts. The guiding system has two attachments that hold a structural support guide that attaches to the concave head of a rod that is used by hydraulic bar lift to lift drilling stems into a holding bin of a direct drilling machine.

2 Claims, 4 Drawing Sheets

STRUCTURAL SUPPORT GUIDING SYSTEM FOR A HYDRAULIC BAR LIFT OF A DIRECTIONAL DRILLING MACHINE

BACKGROUND

The present invention is directed to a structural support guiding system that reinforces a set of rods that are used by a hydraulic bar lift to lift iron tubes into a holding bin of a directional drilling machine.

Horizontal Directional Drilling, is a minimal impact trenchless method of installing underground pipe, conduit, or cables in a relatively shallow arc or radius along a prescribed underground bore path by using a surface-launched drilling rig.

Directional drilling machines, such as the DITCH WITCH, are used to accomplish horizontal directional drilling.

Direct drilling machines use drilling stems that are connected to each other by directional drilling machines and drilling heads that are attached to the end of the drilling stems boring the path wherein conduit will be laid. Drilling stems have male and female fasteners that are attached to each other and directional drilling machines can store up to 150 meters in drilling stems in directional drilling machine holding bins. The drilling stems are made of metal and are heavy in nature.

After bored paths have been created by the directional drilling machines, the drilling stems are collected and housed within the bins of the directional drilling machines (hereinafter DDMs. The DDMs collect the drilling stems and separate each stem prior to housing them within their bins. To house within their bins, the DDMs use hydraulic bar/stem lifts to lift the stems drilling within the bins. Typically, there will be at least two hydraulic bar lifts, separated an equal distance from a central portion of the bin, that will receive each separated drilling stem and lift each stem within the bin. Each hydraulic bar lift uses a concave head that is attached to a rod that goes up and down to push each drilling stem within the bin.

The present invention is a structural support that is used to ensure that the rod of the hydraulic bar lift lifts in a linear line rather than skewing from the linear direction, thereby preventing the breaking of the rod of the hydraulic bar lift. The rod of the hydraulic bar lift may skew from the linear direction when the weight of the bars within the bin increases or when a drilling stem does not rest correctly upon the concave portion of the head of the hydraulic bar lift when storing the bars within the bin. When the rods of the hydraulic bar lift skew past a certain point they tend to break and thereby make the directional drilling machine inoperable.

For the foregoing reason there is a need for a structural support guiding system that reinforces a set of rods that are used by a hydraulic bar lift to lift iron tubes or drilling stems into a holding bin of a directional drilling machine.

SUMMARY

The present invention describes a structural support guiding system that reinforces a set of rods that are used by a hydraulic bar lift to lift iron tubes or drilling stems into a holding bin of a directional drilling machine.

The structural support guiding system is a guiding system that attaches to a direct drilling machine at two distinct points that are adjacent to the direct drilling machine's hydraulic bar lifts. The guiding system has two attachments that hold a structural support guide that attaches to the concave head of a rod that is used by hydraulic bar lift to lift drilling stems into a holding bin of a direct drilling machine.

An object of the present invention is to provide a structural support guiding system that will prevent the rod of a hydraulic bar lift that is used in a direct drilling machine from breaking.

Another object of the present invention is to provide a structural support guiding system that will prevent a direct drilling machine from breaking down.

DRAWINGS

These and other features, aspects, and advantages of the present invention will become better understood with regards to the following description, appended claims, and drawings where:

DESCRIPTION

Figure 1:
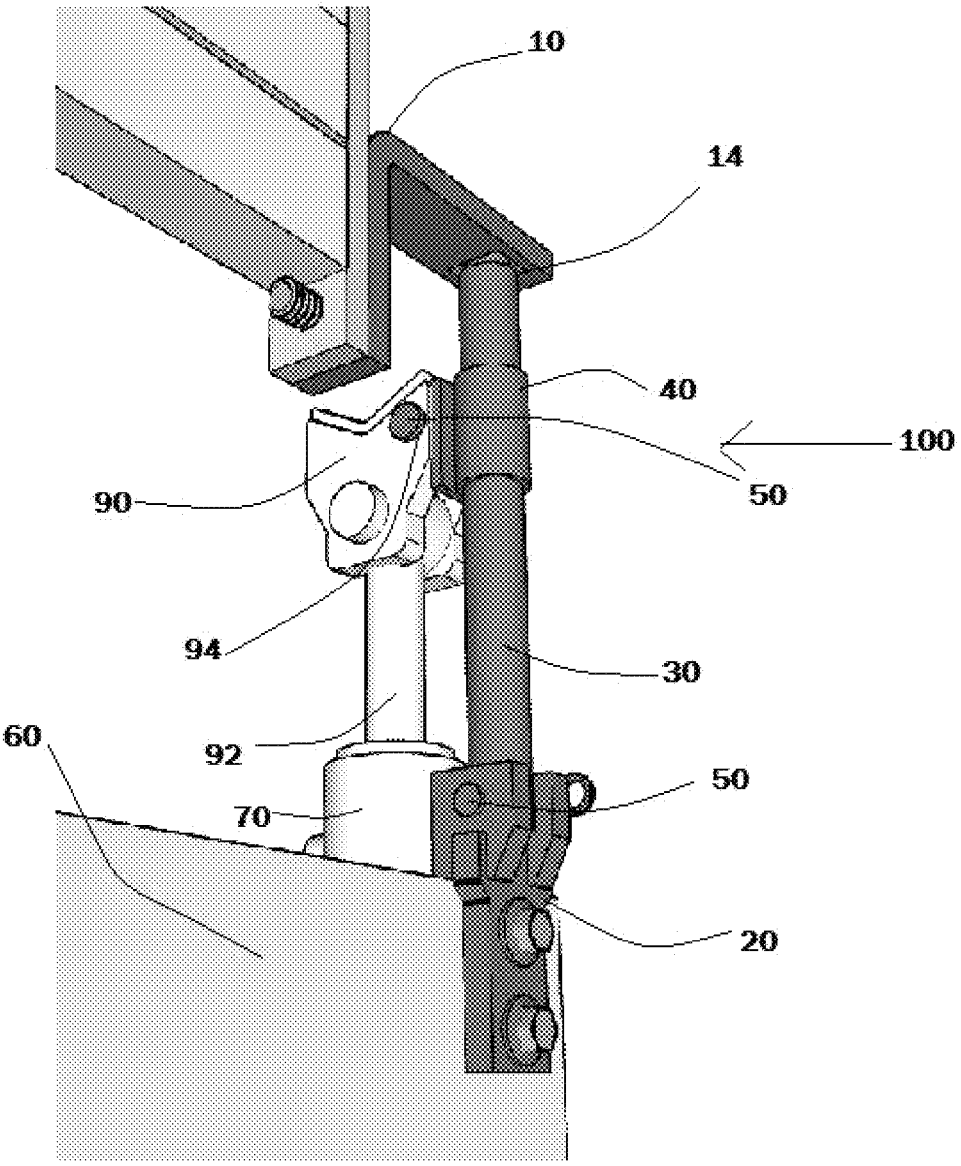
FIG. 1 is a perspective view of the present invention mounted on a direct drilling machine.
Figure 2:
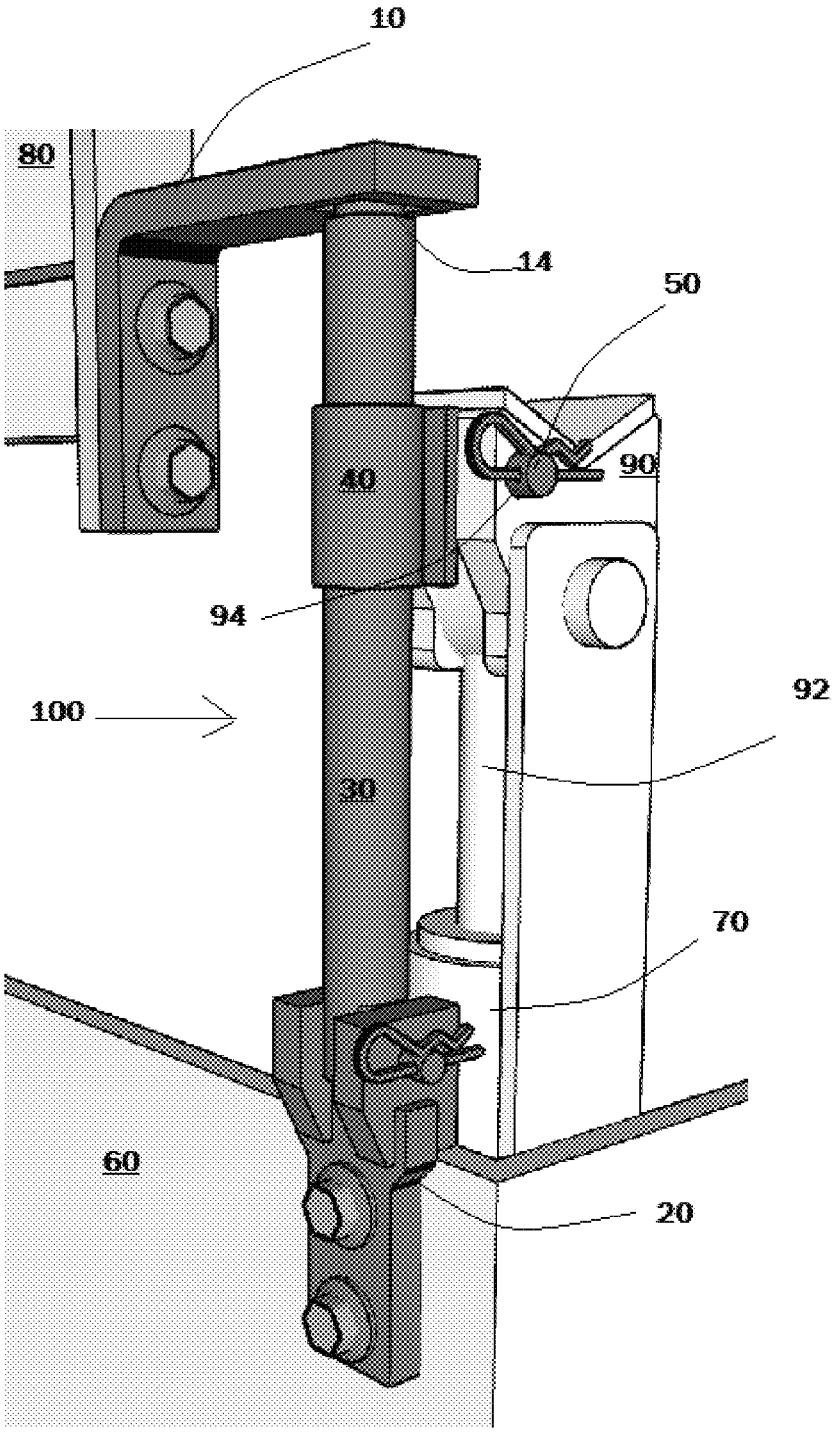
FIG. 2 is another perspective view of the present invention mounted on a direct drilling machine.
Figure 3:
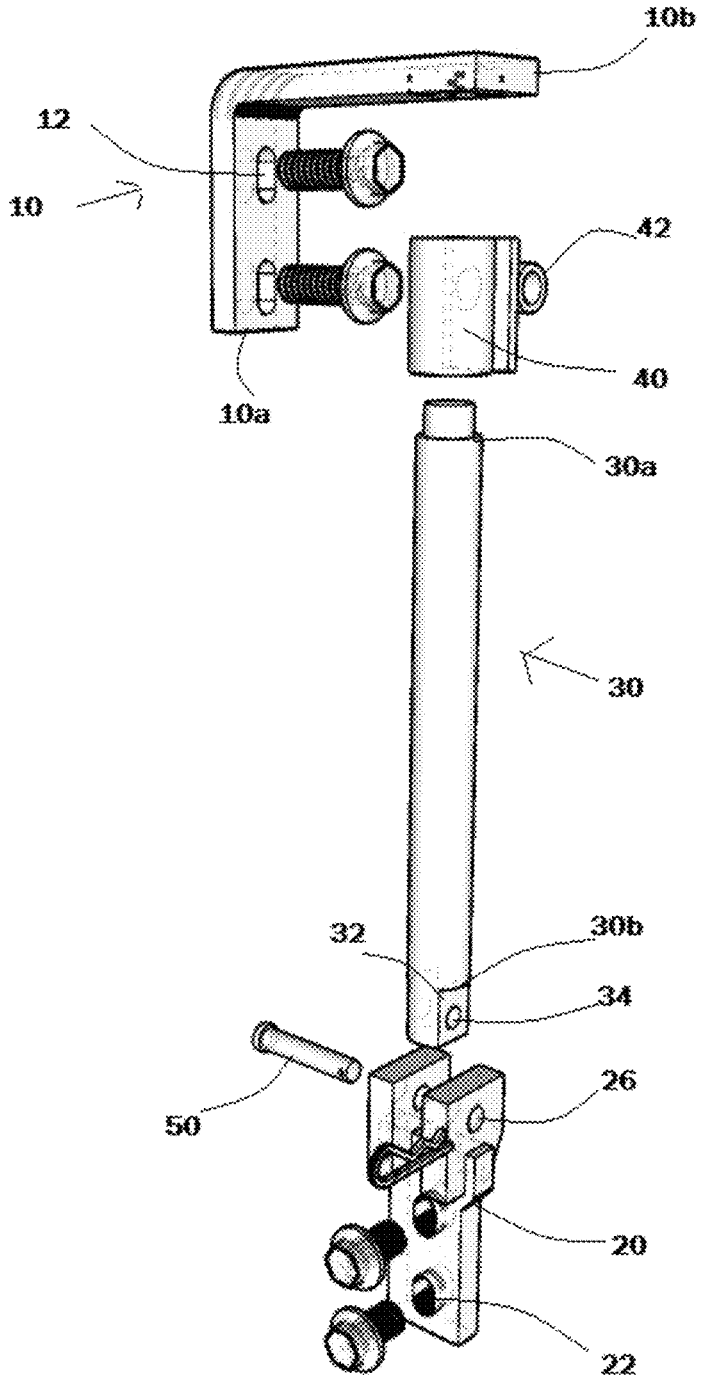
FIG. 3 is a perspective view of the parts of the present invention.
Figure 4:
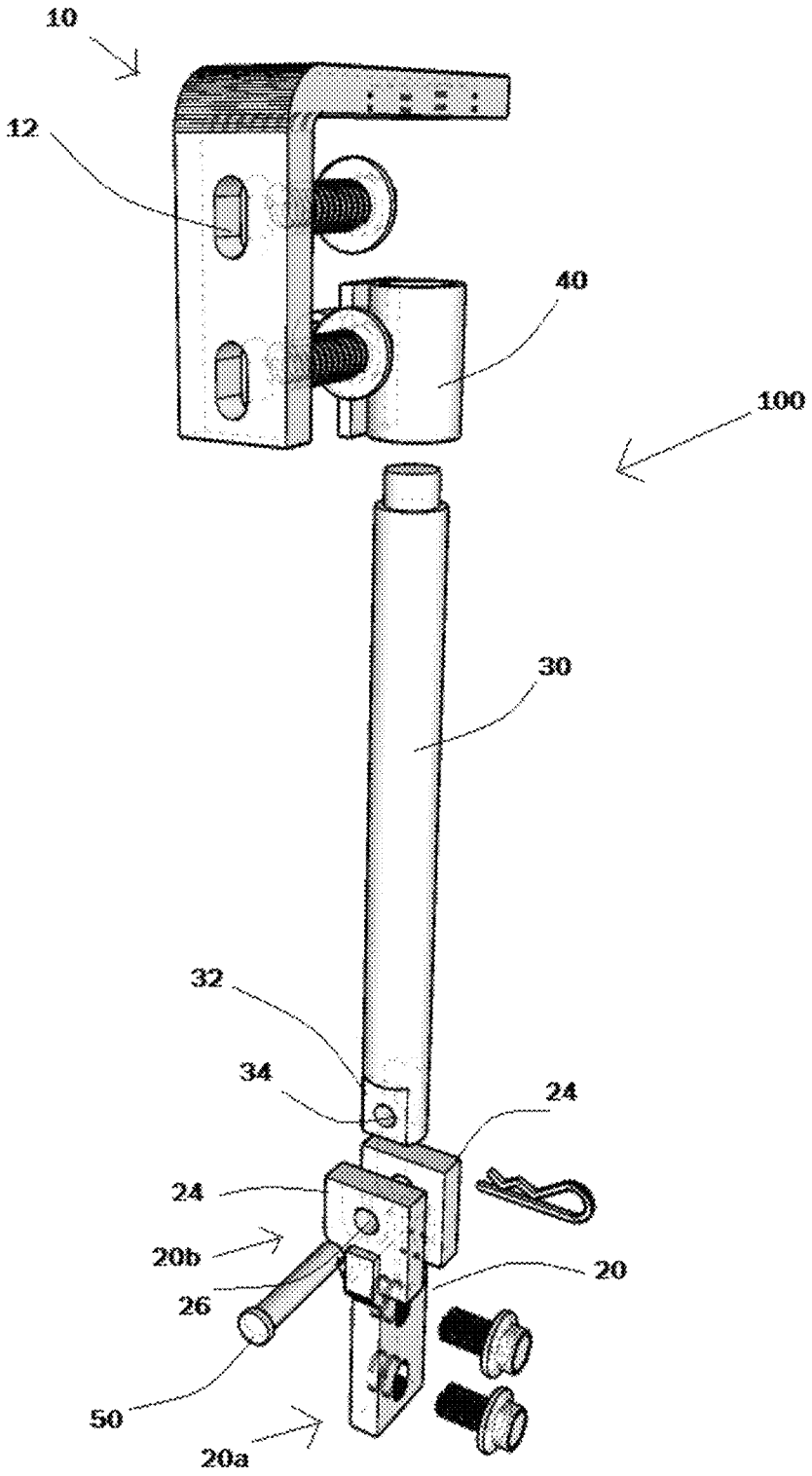
FIG. 4 is another perspective view of the parts of the present invention.

As seen in FIGS. 1-4, the present invention describes a structural support guiding system 100 that reinforces a set of rods that are used to lift iron tubes into a holding bin of a directional drilling machine. The system 100 comprises of a set of L-shaped supports 10, each L-shaped 10 support has a vertical 10*a* and a horizontal side 10*b*, each vertical side 10*a* defines two through holes 12 and each horizontal side 10*b* defines a receiving cavity 14. A set of Y-shaped supports 20, each Y-shaped support 20 has a bottom 20*a* and a top side 20*b*, the bottom side 10*a* defines a pair of through holes 22 and the top side defines two parallel walls 24 that are separated by at least 0.75 of an inch and each wall defines a central through hole 26. A set of support bars 30 that have a top 30*a* and a bottom 30*b*, the bottom side 30*b* of each support bar 30 defines two opposite planar surfaces 32 and a through hole 34 traverses each support bar 30 through the planar surfaces 32. A set of tubular sleeves 40 that define a horizontal pin guide 42. And, a plurality of securing pins 50, wherein each Y-shaped supports 50 is attached to a plate 60 that supports a hydraulic bar lift 70 of a directional drilling machine, each support bar's bottom side 30*b* inserts within the parallel walls 24 of each Y-shaped support 20, one of the securing pins 50 secures each Y-shaped support 20 to each support bar 30, each sleeve 40 mounts on each support bar 30, each L-shaped support 10 attaches to a horizontal bar 80 of the directional drilling machine so that the receiving cavity 14 of the L-shaped support 10 lines up to receive and house the top side 30*a* of each support bar 30, and the horizontal pin guide 42 of each tubular sleeve 40 inserts within an opening of a head 90 that is attached to a rod 92 of the hydraulic bar lift 70, the head 90 of the hydraulic bar lift 70 defines through holes 94 and another of the securing pins 50 secures the tubular sleeve 40 via that horizontal pin guide 42 to the head 90 of the hydraulic bar lift 70.

In a preferred embodiment of the present invention, the direct drilling machine is a DITCH WITCH.

An advantage of the present invention is that it provides a structural support guiding system that prevents the rod of a hydraulic bar lift used in a direct drilling machine from breaking.

Another advantage of the present invention is that it provides a structural support guiding system that prevents a direct drilling machine from breaking down.

While the inventor's above description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. A structural support guiding system that reinforces a set of rods that are used to lift iron tubes into a holding bin of a directional drilling machine, the system comprises:

a set of L-shaped supports, each L-shaped support has a vertical and a horizontal side, each vertical side defines two through holes and each horizontal side defines a receiving cavity;

a set of Y-shaped supports, each Y-shaped support has a bottom and a top side, the bottom side defines a pair of through holes and the top side defines two parallel walls that and each wall defines a central through hole;

a set of support bars that have a top and a bottom, the bottom side of each support bar defines two opposite planar surfaces and a through hole traverses each support bar through the planar surfaces;

a set of tubular sleeves that define a horizontal pin guide; and a plurality of securing pins, wherein each Y-shaped supports is attached to a plate that supports a hydraulic bar lift of a directional drilling machine, each support bar's bottom side inserts within the parallel walls of each Y-shaped support and one of the securing pins secures each Y-shaped support to each support bar, each sleeve mounts on each support bar, each L-shaped support attaches to a horizontal bar of the directional drilling machine so that the receiving cavity of the L-shaped support lines up to receive and house the top side of each support bar, and the horizontal pin guide of each tubular sleeve inserts within an opening of a head that is attached to a rod of the hydraulic bar lift, the head of the hydraulic bar lift defines through holes and another of the securing pins secures the tubular sleeve via that horizontal pin guide to the head of the hydraulic bar lift.

2. The structural support guiding system that reinforces a set of rods that are used to lift iron tubes into a holding bin of a directional drilling machine of claim 1, wherein the two parallel walls are separated by at least 0.75 of an inch.

* * * * *